United States Patent [19]

Lawrence

[11] Patent Number: 4,502,462

[45] Date of Patent: Mar. 5, 1985

[54] WOOD STOVE

[76] Inventor: Brent Lawrence, 2408 Broadway NE., Albuquerque, N. Mex. 87102

[21] Appl. No.: 440,989

[22] Filed: Nov. 12, 1982

[51] Int. Cl.[3] ..... F24C 1/14

[52] U.S. Cl. ..... 126/77; 126/112; 110/214

[58] Field of Search ..... 126/61, 63, 66, 67, 126/69, 75, 77, 83, 112, 66, 245; 110/214, 326, 322

[56] References Cited

U.S. PATENT DOCUMENTS

| | | | |
|---|---|---|---|
| 225,208 | 3/1880 | Blanchard | 126/77 X |
| 554,499 | 2/1896 | Schnigle | 126/77 X |
| 993,299 | 5/1911 | Howard | 126/77 |
| 2,715,398 | 8/1955 | Smith et al. | 126/77 X |
| 2,948,276 | 8/1960 | Harding | 126/77 X |
| 4,338,913 | 7/1982 | Good | 126/77 |

*Primary Examiner*—Randall L. Green
*Attorney, Agent, or Firm*—William F. Frank

[57] ABSTRACT

The present invention is a vertically loaded wood-burning stove in which the wood stands on end and burns only on the lower end, sliding down into the combustion zone as it is consumed. The wood-burning chamber is air tight with the exception of unobstructed air inlets at the bottom of the chamber. The hot combustion gases pass from the combustion chamber through unobstructed air passageways to a second combustion chamber which is vertically arranged and spaced from the first combustion chamber to form an unobstructed secondary air inlet which provides pre-heated air to the second combustion chamber.

2 Claims, 4 Drawing Figures

WOOD STOVE

FIELD OF INVENTION

The present invention is in the field of the burning of solid materials. More particularly as in the field of wood stoves utilizing improved means for obtaining as complete combustion of the fuels as possible.

BACKGROUND OF THE INVENTION

Wood is not strictly a single fuel. It is a mixture of solids, liquids and gases. Wood burns in three distinct phases, which may proceed in sequence or all at once. In the first phase, free water is driven out of the wood. The water is boiled out by the heat of the fire, thus a lot of calories are used up, which would otherwise be used as heat for a home. A lot of energy is wasted in phase one.

The heat from phases two and three is what powers phase one. In phase two, the wood begins to break down into charcoal, gas, and voliatile liquids. As much as 50% of the potential heat inside a log is released by the burning of the gas and voliatile liquids. However, most of this potential heat escapes up the flue.

In phase three, combustion of the charcoal takes place. It is the charcoal that provides most of the useable heat from a conventional stove. However, as the wood turns to ashes, the ashes smother the charcoal.

Research has shown that a two inch bed of coals will consume all the oxygen in the air admitted into a stove, under normal draft conditions. In this case, almost all of the carbon is being oxidized fully into carbon dioxide. This is ideal. But if the bed of coals is thicker—say three inches—the ideal of complete combustion is completely lost. Now a very large amount of carbon monoxide is produced, and this half-burned carbon will pass up the flue. Half-burned carbon means less heat produced, less efficiency, and a waste of wood.

Modern wood stoves have been dealing with CO emissions by introducing what they call secondary air intakes. This they claim, introduces extra oxygen so the CO can be converted to $CO_2$. Also, the secondary air allows the other volatiles to ignite and burn, thus increasing efficiency. However, they leave out the fact that this secondary burning cannot be achieved at temperatures below 1100° F.

Examples of such stoves as discussed in the preceding paragraph are U.S. Pat. Nos. 2,190,343; 4,102,318; 4,228,783; 3,168,088 and 4,201,185.

The newest stoves on the market are advertising catalylitic converters, which lowers the temperature necessary for complete combustion of the CO and other volatiles. These stoves are very expensive and really only lower the necessary temperature to about 800° F.

Modern air tight stoves allow a longer burning time of the wood by choking the air supply down to allow a slower burn. A slow burn causes the temperature inside the stove to lower, thus only worsening the objective—complete, efficient, clean combustion.

In contrast, consider how a bonfire burns. A bonfire gets extremely hot, emits almost no smoke, and little ash remains after all the wood is consumed. In terms of calories emitted per pound of wood burned, no stove can match the efficiency of a bonfire. Everything is totally consumed, the carbon, wood gases, tars, and other voliatile liquids. Everything except the water and ash, of course. Obviously there is a drawback, a large amount of heat is produced in a short period of time.

SUMMARY OF THE PRESENT INVENTION

The present invention is a vertically loaded wood burning stove. The wood stands on end and burns from the bottom up. Or rather, the wood burns on the bottom end and slides down into the combustion zone as it is consumed.

The wood chamber is air tight, with exception of the unobstructed air inlets placed at the bottom. The wood will not burn above the burn zone because there is no oxygen present. Only the bottom six inches or so have oxygen available for combustion.

The large air vents are normally wide open, allowing the combustion all of the oxygen it needs. This is just like a bonfire, except only a portion of the wood is burning at one time. The fire burns fiercely, but since a small amount of wood is burning the heat is not as intense as a large bonfire. What we have is a mini-bonfire.

As to the three phases of combustion in this stove the three phases happen almost simultaneously. Since there is no shortage of heat, fuel or oxygen almost complete combustion takes place. There is an unobstructed secondary air inlet between the wood chamber and secondary combustion chamber. This allows even more air available to ignite the gases. Because of its location between the wood chamber and secondary combustion chamber, the air is preheated. The preheating of the secondary air is absolutely essential for maximization of combustion. The Bernoulli effect pulls the heated secondary air into direct contact with the flame passing from the first chamber to the secondary combustion chamber. A view port installed in the stove showed that the bottom half of the secondary combustion chamber is completely filled with flames. The temperatures inside the combustion chamber well exceeds the necessary 1100° F. criteria, at all times.

BRIEF DESCRIPTION OF THE DRAWINGS

The present invention will be illustratively described in an embodiment shown in the accompanying drawings.

DETAILED DESCRIPTION OF THE INVENTION

Figure 1:
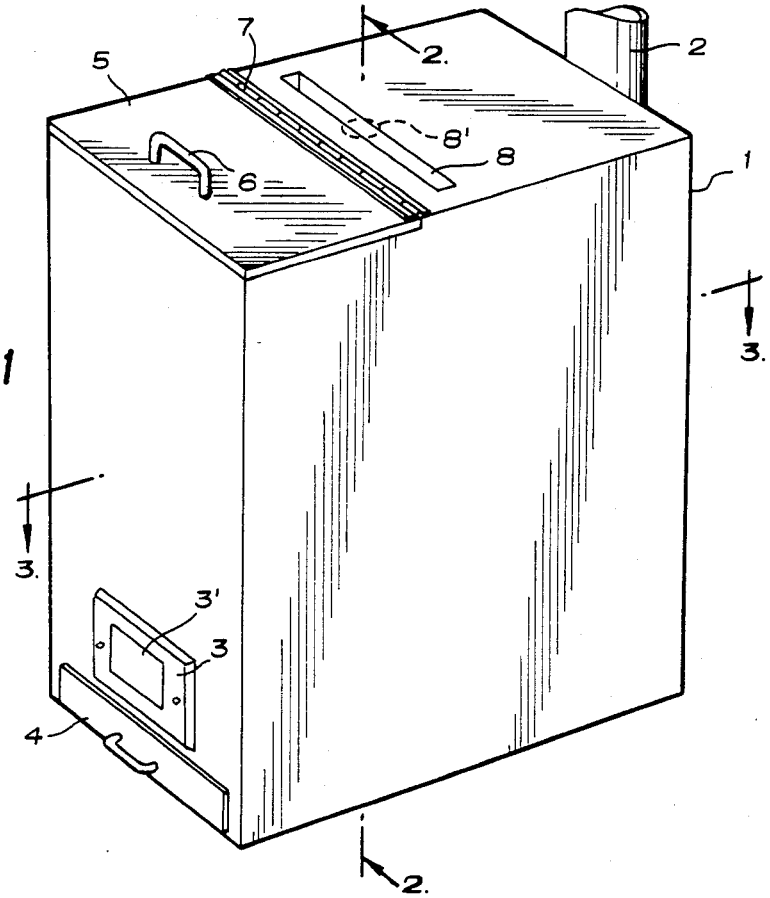
FIG. 1 is a perspective view of the stove of the present invention.

Referring now to FIG. 1 the Stove of the present invention has an outer shell 1 from which runs a flue 2 for the escape of the combustion gases and smoke if any. The front surface of the stove has a draft door 3 and an inspection port which is transparent 3'. An ash door 4 is located at the bottom of the shell 1. A fuel loading door 5 with handle 6 is hingedly connected at 7 to the remainder of the top of the shell 1. A vertical slot 8 is the secondary air intake.

Figure 2:
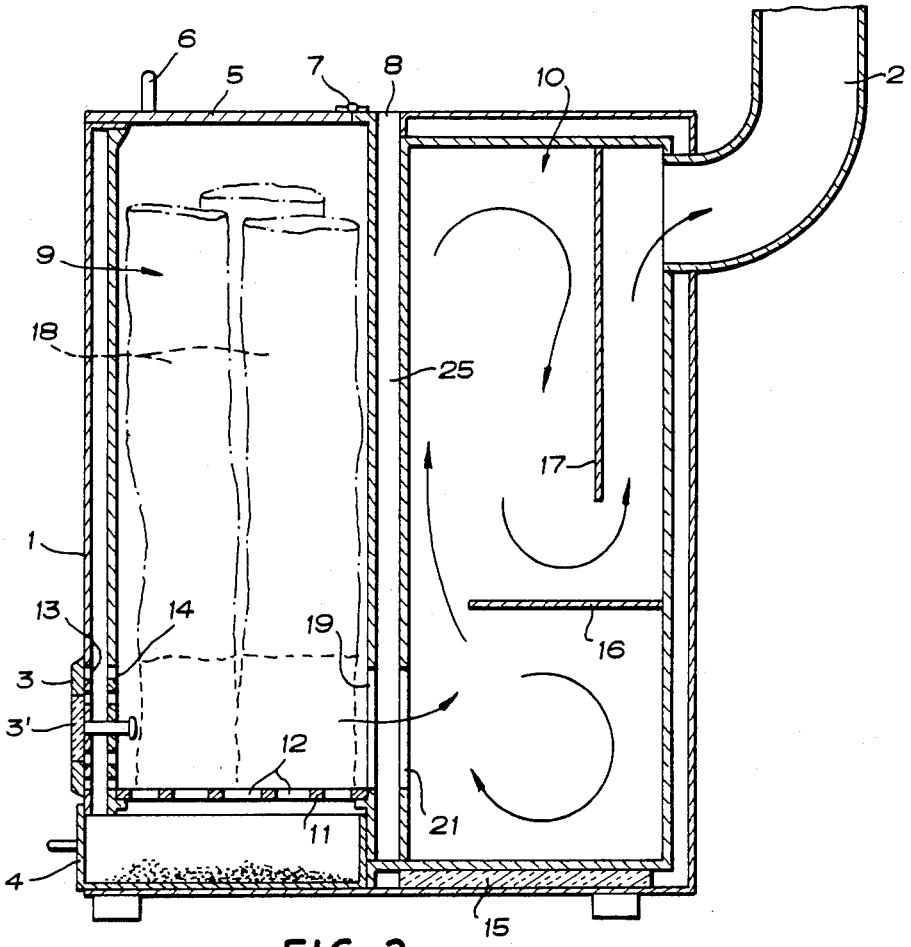
FIG. 2 is a schematic cross-sectional view along plane 2—2 in FIG. 1.

Referring now to FIG. 2 it will be seen that the stove consists of a primary combustion chamber 9 and a secondary combustion chamber 10. In the lower part of the primary combustion chamber 9 is a grate 11 having slots 12 therein so whatever ash is formed and not consumed can pass. The shell 1 has an unobstructed opening 13 which in cooperation with unobstructed opening 14 in the front wall of the combustion chamber 9 provides the air passages. These openings are filled by in each of the shell and the front wall of the combustion chamber 9 permit the passage of air when the damper plate 3 is open. The secondary combustion chamber 10 may rest on fire bricks 15 or may be suspended from the primary combustion chamber 9 by means of steel plates 24 seen in FIG. 3. These plates are welded to the two combustion chambers and provide the space therebetween which is connected with slot 8 in the top of the shell 1 for the secondary inlet 25 of air. Between combustion chambers 9 and 10 there is an unobstructed opening 19 and chamber 9 and an unobstructed opening 21 in chamber 10. A horizontal baffle 16 extends part way across combustion chamber 10 above the inlets of the opening 21 and a vertical baffle 17 depends from the top of combustion chamber 10 as seen in FIG. 2. The wood is loaded into the combustion chamber 9 as indicated at 18 in FIG. 2. It will be seen there that the wood is loaded so that it is vertical within the combustion chamber.

Figure 4:
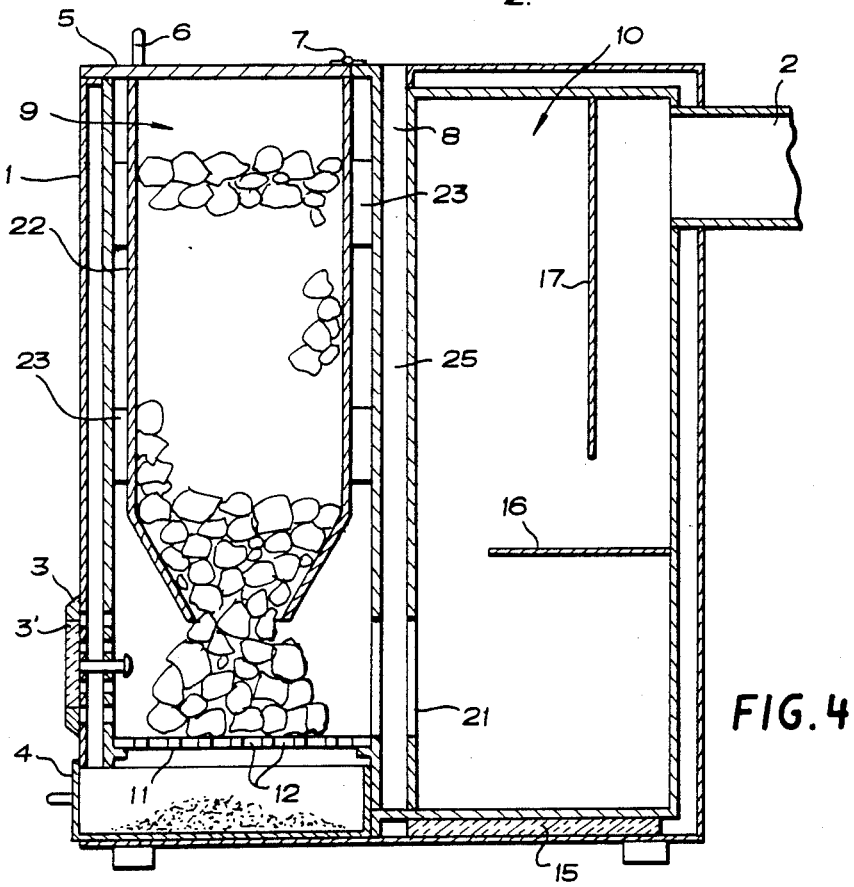
FIG. 4 is another embodiment of the invention as shown in FIG. 2.

In FIG. 4 there is a modification in which a steel cylinder 22 having a tapered lower portion is supported within combustion chamber 9 by brackets 23. Except for this insertion of the cylindrical container for holding coal or coke or similar carbonaceous material the functioning of the stove is substantially identical to that shown in FIG. 2.

Figure 3:
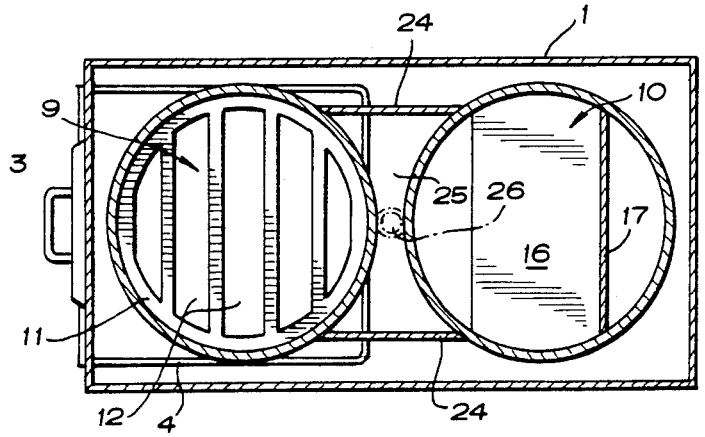
FIG. 3 is a schematic cross-sectional view along the plane 3—3 of FIG. 1.

In lieu of the plates 24 to form the secondary air inlet 25, a suitable length of pipe can be welded to the two combustion chambers as shown in phantom lines at 26 in FIG. 3. The opening in the shell 1 would then be circular 8′ as in FIG. 1.

OPERATION OF THE PRESENT INVENTION

The loading cover 5 is raised and the wood is placed in the primary combustion chamber on end as indicated in FIG. 2. The fire is then started on the grate 11 and the damper 3 is opened wide. The ends of the wood on grate 11 ignite quickly and because of the position of openings 19 and 21, opposite the damper 3 and at the same level the flames from the burning wood pass directly into the secondary combustion chamber 10. The passage of the hot gases from the primary combustion chamber into the secondary combustion chamber draws a secondary supply of air down through opening 8 into the secondary combustion chamber. This secondary source of air is preheated by its downward passage between the outer walls of the primary and secondary combustion chambers. The secondary supply of air causes the gases in the secondary combustion chamber to burn even more fiercely as they continue into the upper part of the secondary combustion chamber as directed by baffle 16 they continue to burn as they then pass under the lower edge of baffle 17 and out into the flue 2, the combustible products within the stove are completely consumed.

Any type of wood seems to burn equally well. The efficiency of this particular invention may be found in that when it was burned in a shop of 900 square feet during the period November of 1981 to March 1982, the only amount of ash that was removed amounted to approximately four gallons. The flue and accompanying chimney were carefully inspected and it was found that there were no deposits of creosote on the walls thereof. The stove was used primarily to heat a workshop and based upon the greater consumption it was determined that the cost of wood had it been purchased would have been about twenty-two dollars per month.

It was found that with the wood arranged in the manner described herein the fire appeared to burn evenly and consistently with the unburned wood lowering itself down into the fire zone as the lower portions were consumed. It was also found that the stove maintained a substantially constant heat output the temperature remained fairly constant varying no more than two degrees on an hourly basis from a mean recording.

An addition of a blower unit advanced in the shell or the use of conduits therefrom would permit the stove to be utilized to heat larger areas and even to force heated air into adjacent rooms. Tanks for the purpose of providing hot water could also be placed within the shell by enlarging it.

Modifications in dimensions and materials will occur to those skilled in the art but such are considered to remain within the scope of the concept of the present invention as recited in the following claims.

What is claimed is:

1. A stove for burning solid carbonaceous fuel comprising an elongated vertical primary combustion chamber having a sealable top plate and a sealed bottom plate, an elongated vertical secondary combustion chamber having sealed bottom and top plates, said combustion chambers being spaced from one another and connected to each other along their length to provide a secondary air inlet passage to said second chamber of preheated air, grate means positioned in the lower most portion of said primary chamber, unobstructed primary air passage means diametrically placed in the front and rear walls of said primary chamber at the level of said grate means, unobstructed air passage means in the front wall of said secondary chamber at the level of the air passage means in the rear wall of said primary chamber and cooperating with said secondary air inlet passage for the influx of heated secondary air into said secondary chamber, control means for the primary air passage means in the front wall of said primary chamber, a horizontal baffle extending forwardly from the rear wall of the secondary chamber a predetermined distance to provide at least partial retention of the burning gases from said primary chamber within the lower portion of said secondary chamber for mixing with said secondary air before passing said burning gases into the upper portion of said secondary chamber between the inner edge of said horizontal baffle and the front wall of said secondary chamber, a vertical baffle depending from the top plate of said secondary chamber toward said horizontal baffle for additional retention and complete combustion of said burning gases and secondary air mixture before passing any mixture residue through a passageway between the lower edge of said vertical baffle and said horizontal baffle to outlet means from said secondary chamber.

2. The stove according to claim 1 further comprising a shell for said combustion chambers, the top surface of said shell having a hinged sealing lid for loading said fuel into said primary chamber, a slot in said top surface leading to said secondary air passage and an unobstructed opening in the lower front surface of said shell coincident with said air passage opening in the front wall of said primary chamber.

* * * * *